US006443040B1

(12) United States Patent
Marchesini

(10) Patent No.: US 6,443,040 B1
(45) Date of Patent: Sep. 3, 2002

(54) PROCESS FOR MANUFACTURING SCREWS AND A DEVICE FOR ACTUATING THE PROCESS

(75) Inventor: Vainer Marchesini, San Prospero Sulla Secchia (IT)

(73) Assignee: WAM S.p.A., Cavezzo (Modena) (IT)

( * ) Notice: Subject to any disclaimer, the term of this patent is extended or adjusted under 35 U.S.C. 154(b) by 0 days.

(21) Appl. No.: 09/582,315

(22) PCT Filed: Oct. 13, 1998

(86) PCT No.: PCT/IT96/00276

§ 371 (c)(1),
(2), (4) Date: Jun. 23, 2000

(87) PCT Pub. No.: WO99/32240

PCT Pub. Date: Jul. 1, 1999

(30) Foreign Application Priority Data

Dec. 23, 1997 (IT) ..... M097A0236

(51) Int. Cl.[7] ..... B23B 1/00

(52) U.S. Cl. ..... 82/1.11; 82/47; 82/173; 29/890.048; 72/136

(58) Field of Search ..... 82/1.1, 46, 47, 82/103, 173; 72/136, 137, 129, 727, 890.048

(56) References Cited

U.S. PATENT DOCUMENTS 368,569 A * 8/1887 Caldwell ..... 72/136
2,372,795 A * 4/1945 Rodeck ..... 29/890.048
2,532,239 A * 11/1950 Newlin ..... 72/137 X
2,669,012 A * 2/1954 Bruegger ..... 29/890.048
2,939,506 A 7/1960 Moore
3,685,330 A * 8/1972 Funke ..... 72/136
5,927,123 A * 7/1999 Liu ..... 72/129

FOREIGN PATENT DOCUMENTS

| | | |
|---|---|---|
| BE | 552 064 a | 11/1956 |
| DE | 14 52 455 A | 4/1969 |
| EP | 0 677 711 | 10/1995 |
| GB | 242518 | 11/1925 |

OTHER PUBLICATIONS

Patent Abstracts of Japan, vol. 009, No. 330 (M–442), Dec. 25, 1985, and JP 60 161815 A, Aug. 23, 1985.

* cited by examiner

*Primary Examiner*—Henry Tsai
(74) *Attorney, Agent, or Firm*—Browdy and Neimark

(57) ABSTRACT

A device for manufacturing a screw (2) comprises a cylindrical support (3) having a horizontal axis (x-13 x)and being rotatable there about. A straight bar (7) is wound spirally about the support (3). The bar (7) is constrained to a guide (8) and can perform movements in a parallel direction to the axis (x—x) of the support (3) on command of a translator provided with an endless screw (14). The process for manufacturing the screw comprises controlling axial movement of the guide (8) in a predetermined rapport with the rotation of the support (3). The invention is particularly applicable in the manufacture of a screw for a screw conveyor.

10 Claims, 3 Drawing Sheets

3
2
7
9
β
8
7a
4

1
11
2
12
8
13
5
13
3
16
α
7
9
10
4
6
7a x
5
3
1
16
8
11
2
7a
4
6
x
13
12
14
10
15

PROCESS FOR MANUFACTURING SCREWS AND A DEVICE FOR ACTUATING THE PROCESS

CROSS REFERENCE TO RELATED APPLICATION

The present application is the national stage under 35 U.S.C. 371 of PCT/IT98/00276, filed Oct. 13, 1998.

TECHNICAL FIELD

The invention relates to a process for manufacturing screws and device for actuating the process. In particular, though not exclusively, the invention relates usefully to a manufacturing process for production of screw-type conveyors.

BACKGROUND ART

The prior art teaches manufacturing processes in which a bar, generally straight, flat and having a constant straight transversal section, is wound upon itself so as to form a relatively short spiral which is then lengthened by traction force. The form of the screw thus obtained does not normally correspond to the desired shape, so that it usually has to be re-worked by plastic deformation up until it reaches the desired conformation. The above-mentioned adjustment phase must be performed with considerable precision, and requires long and laborious working times.

GB 242518 discloses a process for manufacturing a worm conveyor comprising the following operations: fixing an end of a longitudinally elongate body to an elongate support; commanding a rotation of tire support about a longitudinal axis of rotation thereof constraining tie elongate body to a guide arranged in proximity of tile support and able to move in a parallel direction to a direction of the axis of rotation of tire support, the body winding spirally about the support by effect of a rotation of tile support and an axial movement of the guide.

EP 677711 discloses a process for manufacturing a freezing drum comprising the winding of a metal strip on a cylindrical surface by deformation of the strip from a rectilinear configuration to a helical configuration driving an edge of the strip into tight contact with the surface. The winding of the metal strip is performed by means of a device equipped with means to make the surface rotate around its own axis while a couple of rollers drive the strip into tight contact with the surface. The rollers are mounted on a movable block which translates along a direction parallel to the axis of rotation of the surface.

A further drawback in the prior art is the fact that manufacturing variable-step screws involves a number of complications. This type of screw is produced, for example, by joining up one after another several lengths of screw having various steps. This is a complicated methodology, nor does it allow for production of screws with progressively-varying steps, but only with discrete changes in step.

The main aim of the present invention is to obviate the above-mentioned limits and drawbacks in the prior art by providing a process which advantageously enables screws to be manufactured simply and economically, especially those screws destined to be used as conveyors.

A further advantage of the invention is to reduce considerably the manufacturing times for the screws.

A still further advantage is the extreme precision and constancy of the results obtained using the process in line with the nominal dimensions of the design specifications, especially concerning the screw step. Furthermore, the invention enables very precise screws to be obtained, whatever the material the screw is made of.

A further advantage of the screw is to enable variable-step screws to be made which are relatively simple and economical.

A further aim of the invention is to manufacture a constructionally simple and economical device for carrying out the above-described process.

DISCLOSURE OF INVENTION

These aims and advantages and more besides are all attained by the invention, as it is characterised in the appended claims.

Further characteristics and advantages of the present invention will better emerge from the detailed description that follows of a preferred but non-exclusive embodiment of the invention, illustrated purely by way of a non-limiting example in the accompanying figures of the drawings, in which.

Figures 1, 5:
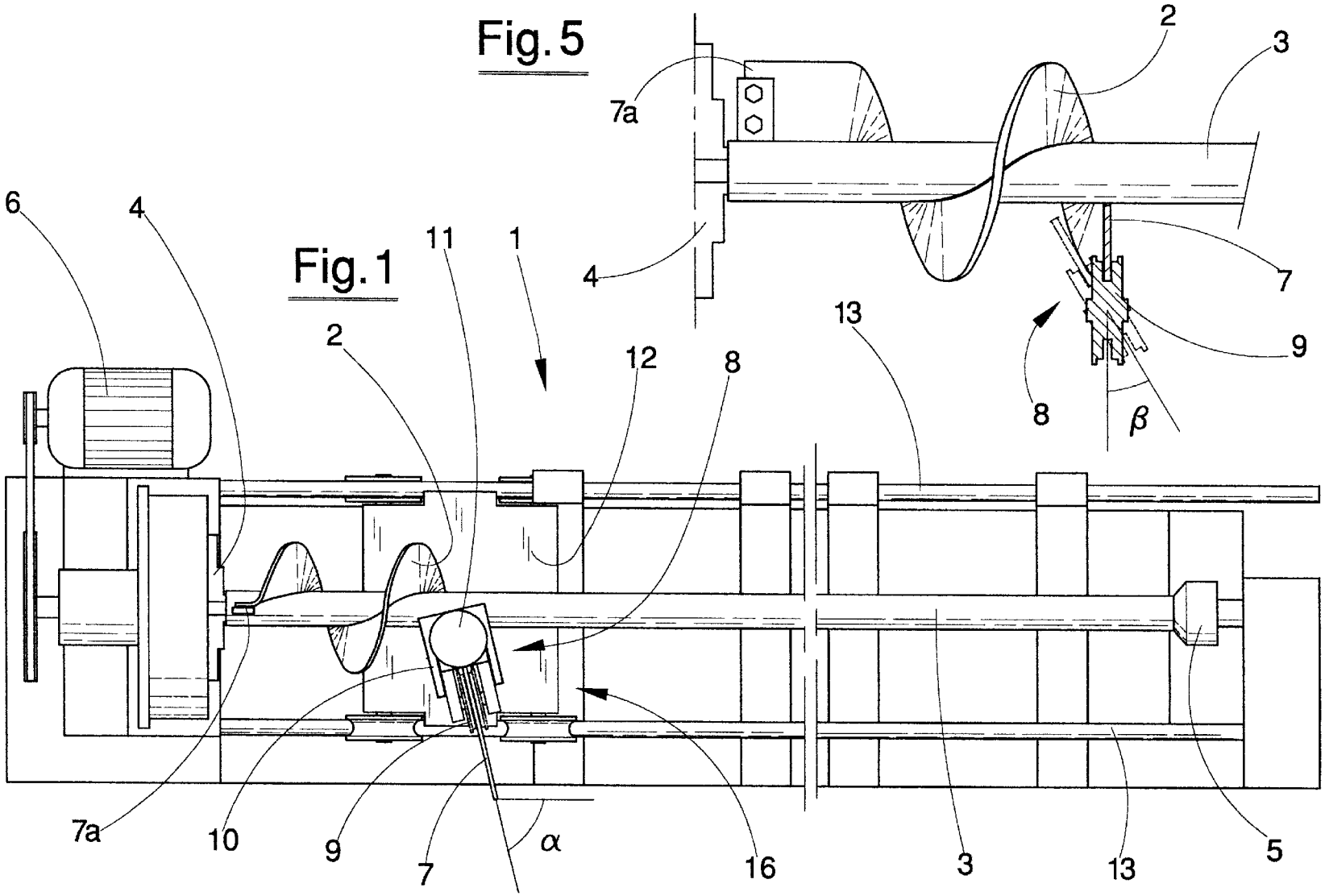
FIG. 1 is a schematic view from above of a device made according to the present invention during its functioning cycle.
Figure 2:
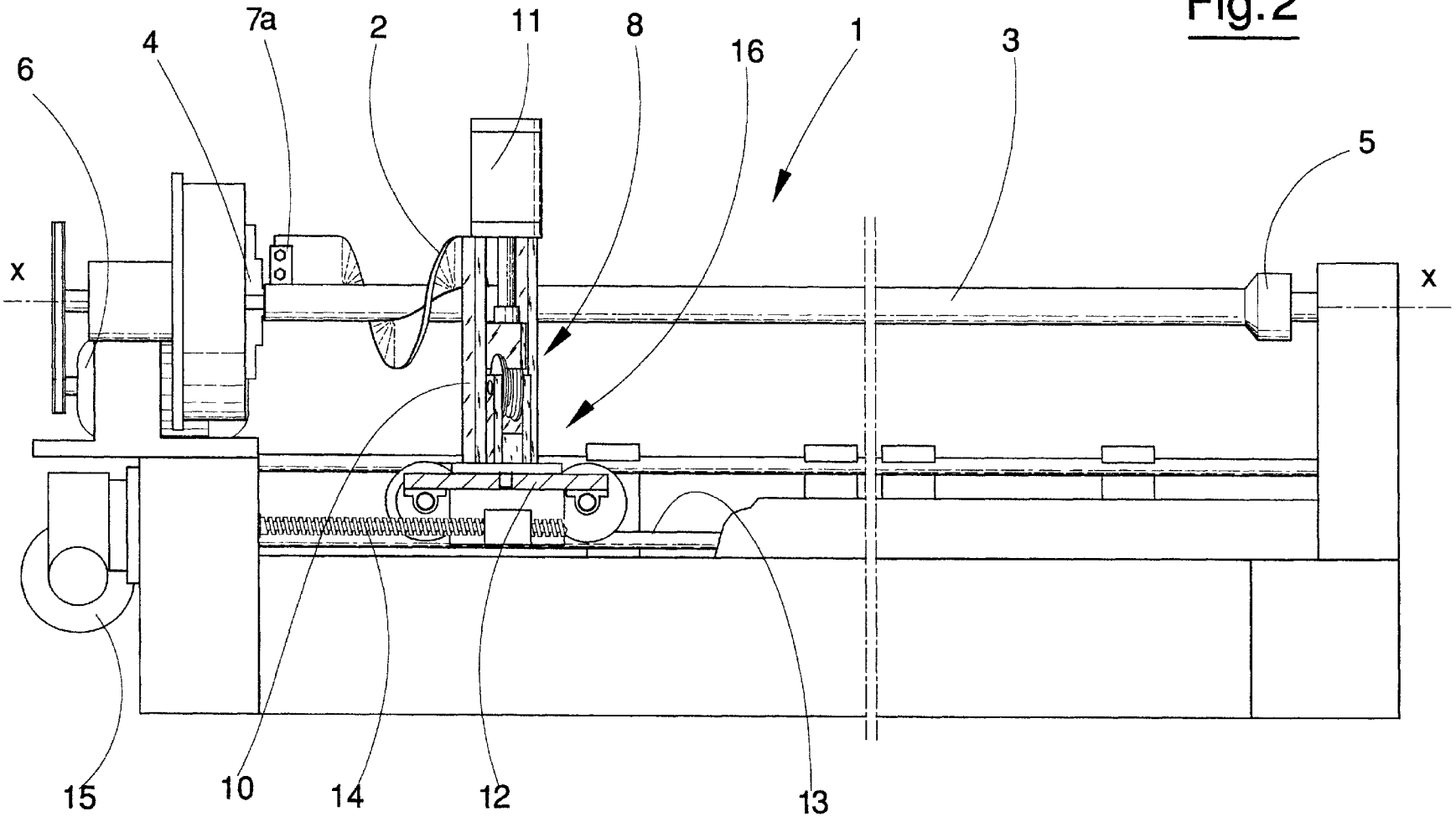
FIG. 2 is a lateral view from below of FIG. 1.

FIG. 5 schematically shows the view of FIG. 2, evidencing two different possible operative configurations assumed by the means for guiding the longitudinal body destined to form the screw.

With reference to the above-mentioned figures, 1 denotes in its entirety a device for manufacturing a screw 2, for example for use as a screw conveyor.

The device 1 comprises a winder support 3, constituted in the example by a cylindrical support, having a longitudinal axis x—x which is arranged horizontally.

The cylindrical support 3 constrained at both ends by two opposite heads 4 and 5 of a horizontal-axis chuck driven by an electric motor 6. The support 3 can rotate on command about its own longitudinal axis x—x, with controlled and adjustable speed.

An end 7*a* of an elongate body is removably constrained to the cylindrical support 3. The body 7 is destined to wind spirally about the support 3 to produce a screw 2. The body 7 is constituted in the example by a flat rectangular bar with a straight constant transversal section. In the example the bar, before being spiral-wound about the support, is straight. The removable fixture of the end 7*a* of the body to the rotating support 3 can be realised, for example, by means of one or more screw-type constraints. The figures show that the bar is fixed to the support with the flat part arranged perpendicularly with respect to the external surface of the support itself.

The device 1 comprises a mobile group, denoted in its entirety by 16, which can move in a horizontal direction parallel to the axis x—x of the support 3 in both directions. The mobile group 16 bears a guide 8, situated in proximity of the support 3, to which the body 7 is constrained before being wound about the support. The guide 8 comprises two rotatable pulleys 9 each of which exhibits at its periphery a gullet within which the body 7 can roll. The two pulleys 9 are mounted on a support body 10 and can rotate idle about two respectively parallel rotation axes. The two pulleys 9 are substantially coplanar and are aligned one after another so as to guide the body 7 destined to be screw-formed. The inclination of the guide direction with respect to the rotation axis x—x of the support 3 is variable on command. Alpha denotes the angle formed by the guide direction vector and axis x—x. The guide 8 further comprises a pressor organ 11, constituted in the example by a hydraulic cylinder, which presses the body against the pulleys 9 so as to hold it in position, especially during its winding about the support 3. Other types of guides might be used, conformed and arranged so as to guide the body 7 according to a predetermined guide direction and to spiral-wind it about the support 3.

The mobile group 16 comprises a mobile base 12, mobile in a parallel direction which is parallel to the longitudinal axis x—x of the support. The base 12 comprises a sliding carriage which runs on wheels along two straight horizontal guides 13 arranged side-by-side at the opposite sides of the carriage. The support body 10 of the bar guide is rotatably coupled to the base 12 and can rotate about a vertical axis. Furthermore, the guide group formed by the pulleys 9 and the pressor 11 is rotatable on command with respect to the support body 10 about a rotation axis which is parallel to the guide direction.

The guide 8 is thus able on command to make at least the following movements:

1) movements parallel to the longitudinal axis x—x of the support together with the mobile group 16;
2) displacements with respect to the base 12 so as to vary the guide direction, that is, the inclination with which the body is wound on the support 3, and therefore the step of the screw which is being formed around the support 3.

Figure 3:
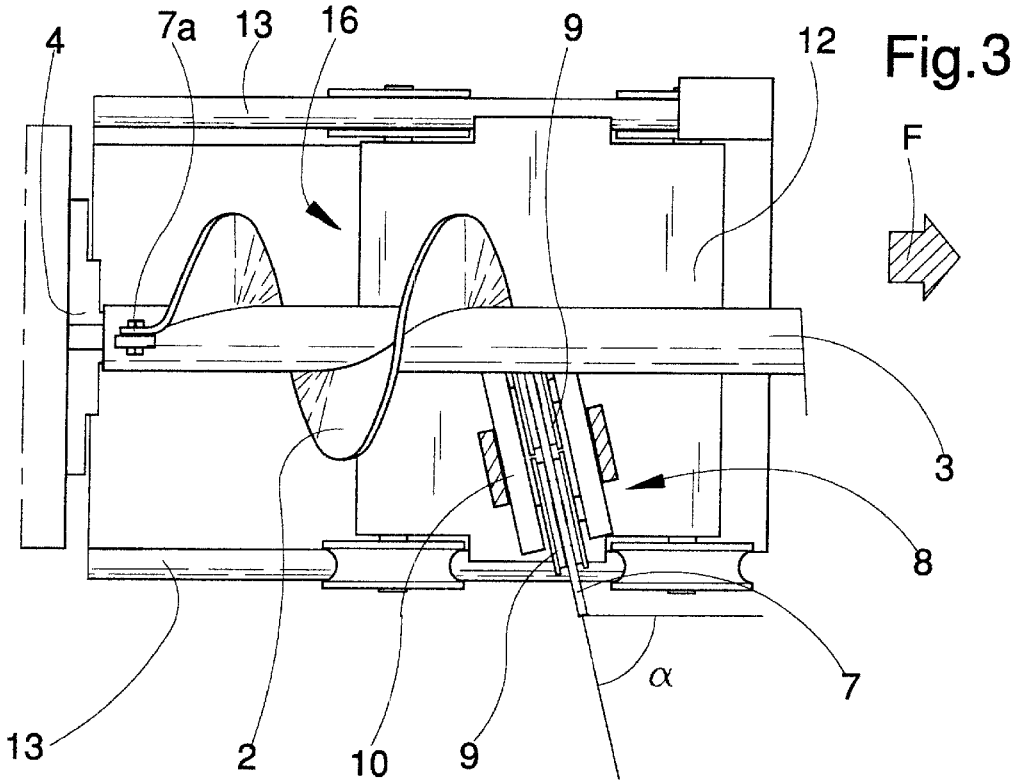
FIG. 3 is an enlarged detail of FIG. 1, with some parts removed better to evidence others.
Figure 4:
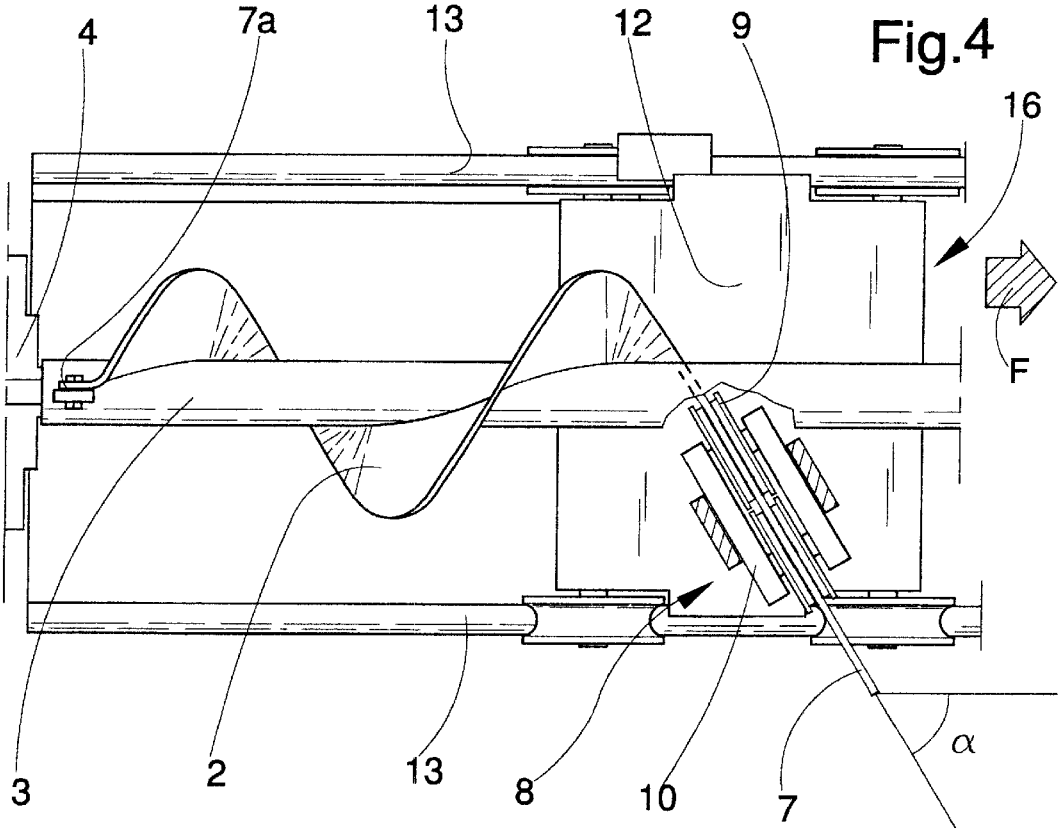
FIG. 4 is the detail of FIG. 3 in a different operative configuration.

These movements of the guide 8 with respect to the base 12 preferably comprise rotations about at least one rotation axis. In the present example the guide 8 can rotate according to two non-parallel rotation axes, in which: a first axis is orthogonal both with respect to the guide direction and to the support 3 rotation axis x—x; and a second axis is parallel to the guide direction. In the example the first rotation axis of the guide is vertical; by effect of the guide rotations about the first rotation axis the angle alpha formed by the direction (variable) of the guide and the direction (fixed) of the rotation axis of the support 3 can be varied within an interval comprises, for example, between 30 and 90 degrees. The controlled variation in this angle alpha can also be performed during the winding phase of the body 7, by means of control organs of known type and not illustrated, so as to obtain a variation in the screw step. In FIGS. 3 and 4 two different possible configurations of the guide means for the body 7 are illustrated, which can be achieved by rotation about the first vertical axis of rotation.

FIG. 5 schematically illustrates two different configurations assumed by the guide group by effect of rotations about the second rotation axis. These rotations cause variations in the angle beta formed by the plane including the pulleys 9 with a perpendicular plane to the rotation axis x—x of the support 3. The angle beta, which can preferably vary between zero and 30°, can be controlledly changed during the winding phase of the body 7, using, for example, a preset computer program.

The movements of the guide 8 with respect to the base 12 can be made, for example, by a coupling comprising a ball-socket joint or equivalent coupling. The control of these displacements during the winding phase in a succession of predetermined displacements means that screws of extreme precision can be obtained. This succession of displacements can be decided according to many different criteria, for example the type of material the body 7 is made of.

The device 1 is preferably but not necessarily provided with means for commanding and controlling the axial movement of the guide 8. The means for commanding and controlling act on means for translating the guide carriage in a parallel direction to support 3 axis. The activation of the means for translating is connected to the means for commanding the rotation of the support 3. In the illustrated example the means for translating comprise an endless screw 14 driven by an electric motor 15 and coupled to the group 16 supporting the guide 8.

The motor 6 rotating the support 3 is provided with sensors for detecting the angular position and rotation speed thereof The sensors, which might comprise. for example, a encoder (not illustrated), send signals to a unit of control and command of the device (not illustrated) which processes the signals using a special program and consequently controls the motor 15 activating the translator of the mobile group 16. The group 16 can thus be advanced controlledly during the winding operation of the body 7 about the rotating support 3, so that the advancement can be correlated with the rotations of the support 3.

The unit for controlling and commanding can change the inclination of the guide 8 about the two rotation axes, in order to vary angles alpha and beta. By regulating the alpha and beta inclinations of the guide 8 of the body 7 during the winding operation, continuously-variable-step screws can be produced.

Furthermore, the possibility of regulating inclinations alpha and beta enables the flat part of the body to be maintained at the desired inclination (generally perpendicularly) to the axis x—x of the support 3, both during and subsequent to winding.

The group 16 advancing program, which also controls the various displacements of the guide 8 of the body 7, can be reprogrammed according to needs, for example in accordance with the type of screw to be manufactured or the material the screw is made of.

During functioning, the end 7*a* of the body is fixed to the support 3. The orientation of the body 7 is predetermined with relation to the axis x—x of the support 3, specially positioning the guide 8 so that the angles alpha and beta are at the predetermined values. The support 3 is then rotated by means of the motor 6, generally at a constant velocity. The rotation of the support 3 winds the body 7 spirally and commands the axial displacement of the guide group 16 in the direction denoted by arrow F.

Where the group 16 is not provided with its own motor but is, for example, freely slidable on the guides 13, its axial displacement is determined by the rotation of the support 3 due to the rigidity of the body 7 and the arrangement of the body in relation to axis x—x. In other words, the group 16 is drawn into axial displacements by the body 7 itself as it moves.

Where the mobile group 16 is controlledly axially displaced by its own motor, the activation of the latter is made to coincide with the support 3 rotation. In the example, the movement of the mobile croup 16 is subordinated to the rotation of the support 3. It has been found that relating the advancement of the mobile group 16 to the support rotation 3, according to a predetermined law and controlled by the above-mentioned control unit, enables a screw 2 with precise dimensions to be obtained, i.e. precise in relation to the design specifications, with no need for further adjustment.

Furthermore, the device of the invention enables a good production rate to be achieved, the manufactured screws being constant in dimensions and extremely precise in relation to the design specifications. In its functioning, the device performs a process for manufacturing screws which comprises the following operations.

Firstly, an end of a longitudinally elongate body is fixed to a support, also longitudinally elongate. The support is then rotated about its own longitudinal axis after first fixing the body to a guide arranged in proximity of the support, which guide can move in a parallel direction to the rotation axis of the support.

During the rotation of the support the body spiral-winds about the support itself due to the effect of the rotation of the support and the axial movement of the guide. During the rotation of the support, the axial movement of the guide can be free or can be predeterminedly commanded and controlled, according to the characteristics of the screw to be manufactured. In particular, the axial movement of the guide can be subjugated to the rotation of the support so that the support rotations and axial displacements of the guide are interconnected by a predetermined and preferably repeatable rapport.

In the above process, it is preferable that the body is constrained to pass through the guide according to a guide direction whose inclination with respect to the axis of the support can be changed during the course of the rotation of the support.

This change in inclination can be made by means of rotations of the guide about a rotation axis whose direction is transversal (preferably perpendicular) with respect both to the guide direction and to the direction of the longitudinal axis of the support.

Furthermore, the guide can also be rotated about a second rotation axis, preferably parallel to the guide direction. This rotation can also be commanded and controlled during the winding phase of the body.

What is claimed is:

1. A process for manufacturing a screw, comprising the following operations: fixing an end (7*a*) of a longitudinally elongate body (7) to an elongate support (3) having a longitudinal axis (x—x); rotating the support (3) about the longitudinal axis (x—x);

constraining the elongate body (7) to a guide (8) arranged in proximity of the support (3), guiding the elongate body toward the support in a guide direction while moving the guide in a direction parallel to the longitudinal axis (x—x) of the support (3), and rotating the guide about a first axis that is parallel to the guide direction for winding the body spirally about the support (3) by effect of rotation of the support (3) and axial movement of the guide (8), wherein the guide direction has an inclination to the longitudinal axis (x—x), and further comprising changing the inclination of the guide direction during the rotation of the support (3).

2. The process of claim 1, wherein the movement of the guide (8) in the direction parallel to the longitudinal axis is linked to the rotation of the support (3).

3. The process of claim 2, wherein the rotation of the support (3) and the axial movements of the guide (8) are reciprocally connected by a repeatable rapport.

4. The process of claim 1, wherein said change of inclination is achieved by causing the guide (8) to rotate about a second axis that is transverse to both the guide direction and the direction of the longitudinal axis of the support (3).

5. A device for manufacturing a screw, comprising:

a motor (6) for rotating an elongate support (3) about a longitudinal axis (x—x) thereof and an end (7*a*) of an elongate body (7) being constrained to said support (3) to be wound spirally about said support (3)with a selected inclination as said support rotates;

a guide (8), located in proximity of the support (3), for constraining the body (7), said guide (8) being able to perform movements in a parallel direction to the longitudinal axis of rotation (x—x) of the support (3);

a mobile group (16), on which said guide (8) is mounted, which is mobile in a parallel direction to the longitudinal axis (x—x) of the support; wherein said guide (8) is mounted for rotation in relation to the mobile group (16) about two non-parallel axes of rotation so as to vary the inclination with which the body (7) is wound about the support (3).

6. The device of claim 5, comprising means for commanding said axial movement of the guide (8) in a predetermined rapport with the rotation of the support (3).

7. The device of claim 6, wherein said means for commanding said axial movement of the guide (8) comprise a screw that is rotated in a manner bearing a selected relation to the rotation of the support (3).

8. The device of claim 5, wherein said guide (8) is conformed and arranged so as to guide the longitudinal body (7) according to a predetermined guide direction and one of said two non-parallel axes of rotation is parallel to tile guide direction.

9. The device of claim 8, wherein the other one of said two non-parallel axes of rotation is perpendicular both to the guide direction and to the longitudinal axis of the support (3).

10. The device of any one of claim 5, wherein said guide (8) comprises at least one rotatable pulley (9) having a gullet on a periphery thereof, which gullet receives the body (7), and at least one pressor (11) for pressing said body (7) against the pulley (9).

* * * * *

UNITED STATES PATENT AND TRADEMARK OFFICE

CERTIFICATE OF CORRECTION

PATENT NO. : 6,443,040 B1
DATED : September 3, 2002
INVENTOR(S) : Marchesini

It is certified that error appears in the above-identified patent and that said Letters Patent is hereby corrected as shown below:

Title page,
Item [86], delete "PCT/IT96/00276" and insert therefor -- PCT/IT98/00276 --.

Signed and Sealed this

Fourth Day of February, 2003

JAMES E. ROGAN
*Director of the United States Patent and Trademark Office*